United States Patent [19]

McGraw, Jr.

[11] 4,246,818

[45] Jan. 27, 1981

[54] SLICER KNIFE SAFETY COVER

[76] Inventor: Veral L. McGraw, Jr., 2528 SW. Spring Garden St., Portland, Oreg. 97219

[21] Appl. No.: 40,529

[22] Filed: May 21, 1979

[51] Int. Cl.[3] ..... B26D 7/22

[52] U.S. Cl. ..... 83/478; 83/545; 83/DIG. 1

[58] Field of Search ..... 83/478, 545, 544, DIG. 1

[56] References Cited

U.S. PATENT DOCUMENTS

| | | | |
|---|---|---|---|
| 2,573,629 | 10/1951 | Klingens et al. | 83/478 X |
| 2,573,860 | 11/1951 | Meeker et al. | 83/478 X |
| 2,619,142 | 11/1952 | Ditting | 83/478 |
| 4,186,634 | 2/1980 | Akczinski, Sr. | 83/478 |

*Primary Examiner*—Frank T. Yost

*Attorney, Agent, or Firm*—Lee R. Schermerhorn

[57] ABSTRACT

A circular cover has a peripheral flange to overhang and enclose the cutting edge of a rotating disk slicer knife in a slicing machine for meat and other foods. A central handle remote from the cutting edge of the knife disc is provided for applying the cover to the knife disk. Magnets recessed in handle protuberances at the rim of the cover secure the cover of the knife disk, these handles being used to pull the magnets free of the knife disk in removing the cover.

11 Claims, 5 Drawing Figures

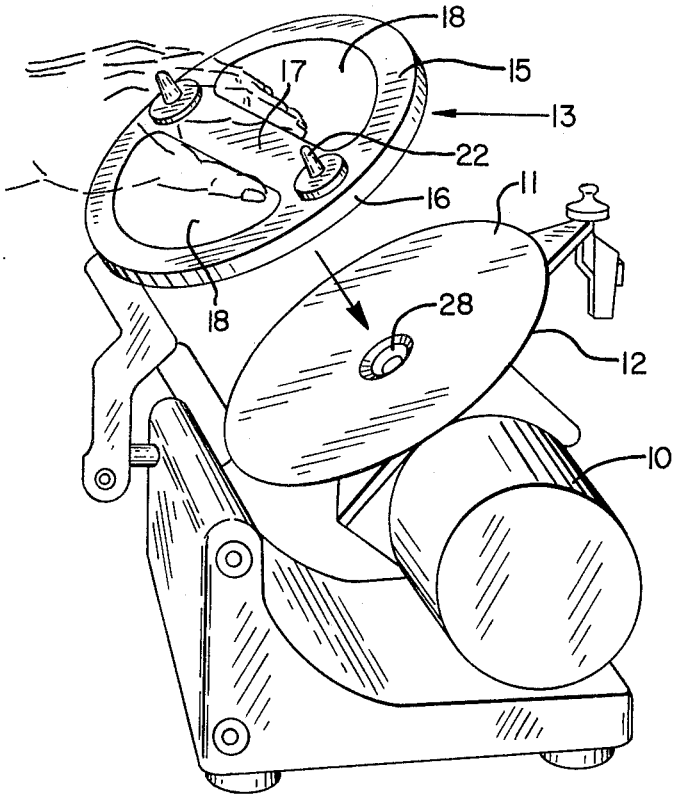
FIG. 1
FIG. 2
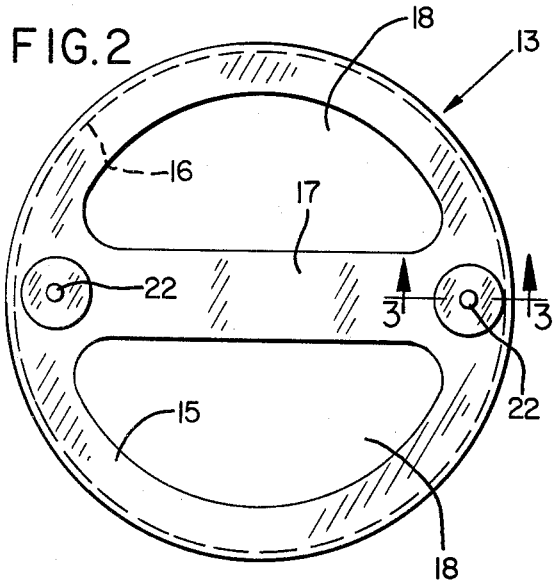
FIG. 4
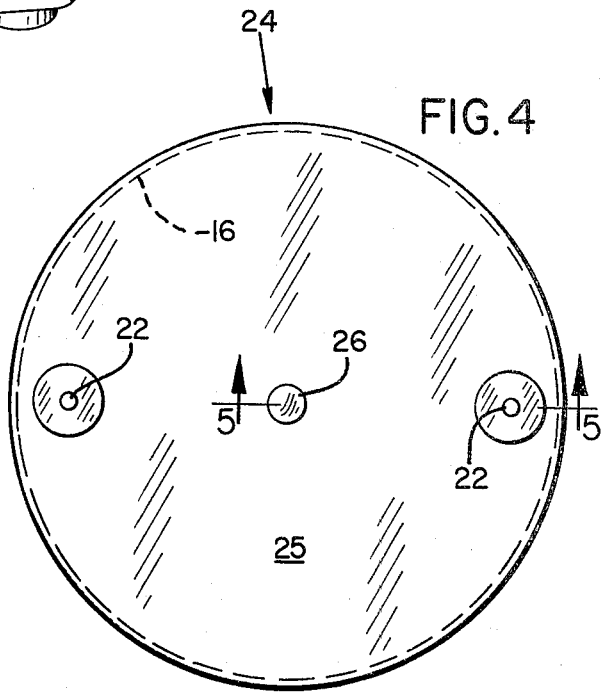
FIG. 3
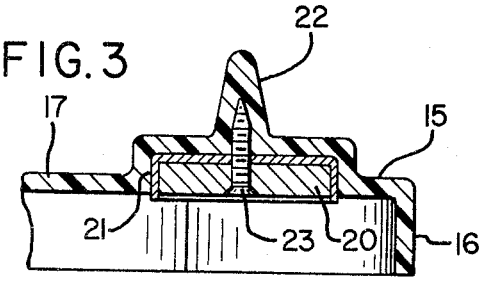
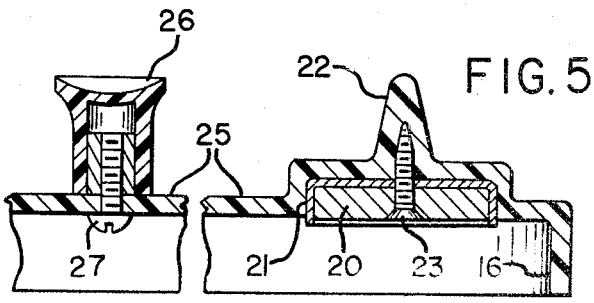
FIG. 5

SLICER KNIFE SAFETY COVER

BACKGROUND OF THE INVENTION

This invention relates to a temporary safety cover to be applied to the rotating disk slicer knife when the operating guard is removed for cleaning the slicing machine.

Slicing machines used in a restaurant for slicing servings of cooked meat and the like have a motor driven rotating disk slicer knife which is normally shielded by a conventional form of guard when the slicing machine is in operation. However, when the machine is to be cleaned or serviced from time to time the normal operating guard must be removed. The exposed sharpened edge of the knife disk then presents a serious hazard to the hands and fingers of a person cleaning or servicing the machine.

Objects of the present invention are therefore to provide a temporary safety cover for application to a rotating disk slicer knife when the normal operating guard has been removed for cleaning or servicing the slicing machine, to provide a safety cover which is secured to the knife disk by magnets and to provide a safety cover of the type described which is of lightweight, simple and economical construction.

SUMMARY OF THE INVENTION

The present knife cover is equipped with magnets to secure it to the flat surface of the knife disk when the normal operating guard has been removed. A circular flange on the cover overhangs and encloses the cutting edge of the disk so that the operator's hands cannot come into contact with the cutting edge while pieces of food are being wiped from portions of the slicing machine under and behind the knife disk. There are preferably a pair of magnets on the underside of the cover to secure the cover at two points on the knife disk and handles are provided on the upper side of the cover overlying said magnets for pulling the magnets free of the disk to remove the cover. A central handle remote from the peripheral portion of the cover which approaches the cutting edge of the knife disk is provided for applying the cover to the knife disk.

Various changes may be made in the details of construction and arrangement of parts and certain features may be used without others. All such modifications within the scope of the appended claims are included in the invention.

BRIEF DESCRIPTION OF THE DRAWING

FIG. 1 is a perspective view of a common form of slicing machine with the food carriage and normal operating guard removed to illustrate the exposed position of the slicer knife disk when the machine is to be cleaned or serviced.

FIG. 2 is a top plan view of one embodiment of safety cover according to the invention.

FIG. 3 is a sectional view on the line 3—3 in FIG. 2.

FIG. 4 is a top plan view of a modification.

FIG. 5 is a sectional view on the line 5—5 in FIG. 4.

DESCRIPTION OF THE PREFERRED EMBODIMENTS

In the slicing machine in FIG. 1 a motor 10 rotates a slicer knife disk 11 having a sharp edge 12 to slice servings from a large piece of meat such as a roast or a ham. In the use of the machine a sliding carriage (not shown) moves the piece of food back and forth across the rotating knife 11 and during this operation the knife 11 is shielded around most of it periphery by a conventional form of guard.

The operating guard is removed in FIG. 1 to illustrate the exposed condition of the sharpened edge 12 when the machine is prepared for cleaning from time to time during the day, or for servicing. The operator must bring his hand close to the sharp edge 12 in wiping away pieces of meat that have fallen below and behind the knife disk 11, this being a dangerous operation, especially when performed in haste as is often necessary in a busy restaurant.

The first embodiment of cover 13 shown in FIGS. 2 and 3 has a narrow rim portion 15 with a perpendicular circular flange 16 to overhang and enclose the cutting edge 12 of the knife. An integral diametrical portion 17 of the cover provides a convenient central handle for applying the cover to the knife 11 as shown in FIG. 1 while leaving the cover open at 18 on opposite sides of handle 17 for economy of construction and reduction of weight.

At each end of handle portion 17 a magnet 20 is mounted in a recess 21 in a handle protuberance 22 by a screw 23. Thus the magnets 20 engage the steel knife disk 11 and secure the cover 13 to the knife disk. The cover is readily removable from knife disk 11 by grasping a handle 22 in each hand and pulling the two magnets 20 away from the knife disk 11. Since the handles 22 are directly connected to the magnets 20 no stress is applied to other parts of the cover in pulling the magnets away from the knife disk and the cover may be made of relatively thin plastic material.

The modification 24 in FIGS. 4 and 5 contains the same magnet 20 and handle 22 arrangement just described but has a continuous plastic cover 25 without the openings 18. In this modification there is an attached knob handle 26 in the center of the cover for appling the cover to the knife disk 11. The head of handle screw 27 in FIG. 5 is received in the central recess 28 in knife disk 11 whereby the protruding screw head does not tend to hold magnets 20 away from contact with the knife disk.

A single central handle and magnet may be used without the rim magnets and handles 22 but the arrangements described above are preferred. Two magnets in opposite sides of the cover insure that the entire circumference of the cutting edge 12 is adequately covered.

What is claimed is:

1. A safety cover for a rotating disk slicer knife comprising a circular member having a rim portion arranged to overlie the rim of said knife, a flange on said rim portion arranged to overhang and enclose the cutting edge of said knife, magnetic means for securing said cover to said knife, and handle means for applying said cover to the knife and removing the cover, said magnetic means comprising a magnet inside said cover, and said handle means comprising a protuberance on the outside of the cover overlying said magnet.

2. A safety cover as defined in claim 1, said magnet being secured to said cover by a screw in said handle protuberance.

3. A safety cover as defined in claim 1, said magnet being contained in a recess in said handle protuberance.

4. A safety cover as defined in claim 1, there being a pair of said magnets and handle protuberances on diametrically opposite sides of said circular member.

5. A safety cover as defined in claim 4 including a third handle in the center of the cover.

6. A safety cover as defined in claim 5 said center handle comprising an integral diametral portion of the cover.

7. A safety cover as defined in claim 5, said center handle comprising a knob.

8. A safety cover for a rotating disk slicer knife comprising a circular member having a rim portion arranged to overlie the rim of said knife, a flange on said rim portion arranged to overhang and enclose the cutting edge of said knife, magnetic means for securing said cover to said knife, and handle means for applying said cover to the knife and removing the cover, said handle means comprising a central handle for applying the cover to the knife and a pair of diametrically opposite rim handles for removing the cover from the knife, said magnetic means comprising a magnet underlying each of said rim handles.

9. A safety cover as defined in claim 8, said magnets being contained in recesses in said rim handles.

10. A safety cover for a rotating disk slicer knife comprising a circular member having a rim portion arranged to overlie the rim of said knife, a flange on said rim portion arranged to overhang and enclose the cutting edge of said knife, securing means inside said cover to engage said knife and secure the cover to the knife, and handle means comprising a protuberance on the outside of the cover overlying said securing means for applying the cover to the knife and removing the cover.

11. A safety cover as defined in claim 10, there being a pair of said securing means and handle protuberances on diametrically opposite sides of said circular member.

* * * * *